United States Patent [19]

Kajiwara et al.

[11] Patent Number: 4,897,342

[45] Date of Patent: Jan. 30, 1990

[54] SILVER HALIDE PHOTOGRAPHIC LIGHT-SENSITIVE MATERIAL

[75] Inventors: Makoto Kajiwara; Masanobu Miyoshi; Kaoru Onodera, all of Odawara, Japan

[73] Assignee: Konishiroku Photo Industry Co., Ltd., Tokyo, Japan

[21] Appl. No.: 339,865

[22] Filed: Apr. 14, 1989

Related U.S. Application Data

[63] Continuation of Ser. No. 228,812, Aug. 2, 1988, abandoned, which is a continuation of Ser. No. 65,178, Jun. 16, 1987, abandoned, which is a continuation of Ser. No. 785,077, Oct. 7, 1985, abandoned.

[30] Foreign Application Priority Data

Oct. 18, 1984 [JP] Japan ..... 59-219485

[51] Int. Cl.[4] ..... G03C 1/08; G03C 1/34

[52] U.S. Cl. ..... 430/569; 430/603; 430/605; 430/608; 430/615

[58] Field of Search ..... 430/603, 605, 608, 615, 430/569

[56] References Cited

U.S. PATENT DOCUMENTS

| | | | |
|---|---|---|---|
| 2,784,091 | 3/1957 | Carroll et al. | 430/615 |
| 3,573,056 | 3/1971 | Baldock et al. | 430/615 |
| 3,901,713 | 8/1975 | Yamasue et al. | 430/569 |
| 4,078,937 | 3/1978 | Tani et al. | 430/569 |
| 4,288,535 | 9/1981 | Kanisawa et al. | 430/569 |
| 4,542,094 | 9/1985 | Koshizuka et al. | 430/569 |

*Primary Examiner*—Paul R. Michl
*Assistant Examiner*—Mark R. Buscher
*Attorney, Agent, or Firm*—Jordan B. Bierman

[57] ABSTRACT

In a method of preparing a light-sensitive silver halide photographic emulsion, silver salt and halide are mixed in the presence of an iridium compound. The emulsion is then chemically ripened by an instable sulfur compound and a nitrogen-containing heterocyclic compound capable of forming a complex with silver.

11 Claims, No Drawings

SILVER HALIDE PHOTOGRAPHIC LIGHT-SENSITIVE MATERIAL

This application is a continuation of application Ser. No. 228,812, filed Aug. 2, 1988, abandoned, which is a continuation of application Ser. No. 065,178, filed 6/16/87, abandoned, which is a continuation of application Ser. No. 785,077, filed Oct. 7, 1985.

BACKGROUND OF THE INVENTION

The invention relates to a silver halide photographic light-sensitive material (hereinafter referred to as a light-sensitive material), and more particularly to a light-sensitive material that is highly sensitive and relatively less in fog and is further remarkably reduced in the dependence of gradations on illuminance.

In recent years, there have been increased demands for highly sensitive light-sensitive materials from various points of view, and the sensitizing techniques have been studied from various aspects.

As an example of the studies concerning a silver halide particle, there is the description of the study in which the quantum efficiency of a silver halide particle is theoretically computed and the influence of the particle size distribution is examined, in 'Interactions Between Light and Materials for Photographic Applications', the preprint of Tokyo Symposium, 1980, p. 91. According to this study, it is suggested that the preparation of a monodisperse emulsion is effective to improve a quantum efficiency, that is to say, it is possible to highly sensitize the emulsion.

In order to actually obtain a highly sensitive emulsion, it is still necessary to chemically sensitize the silver halide emulsion most suitably, even if such a highly sensitizable silver halide emulsion as described above is used. As the sensitizing agents to be used in a chemical sensitization, a sulfur sensitizer, a selenium sensitizer, a reduction sensitizer, a noble metal sensitizer and the like have so far been well-known, and they may be used independently or in combination. In addition, there have been the studies of how to further improve the sensitization effects by making use of such a chemical sensitizer as mentioned above. For example, as has been disclosed in Japanese Patent Publication Open to Public Inspection (hereinafter called Japanese Patent O.P.I. Publication) No. 30747/1983, there has been disclosed a method that a chemical sensitization is carried out in presence of a silver halide solvent. A particularly useful method is that, as described in Japanese Patent O.P.I. Publication No. 126526/1983, a chemical sensitization is to be carried out in presence of a nitrogen-containing heterocyclic compound capable of forming a complex with silver. After having continued a further study, the present inventors have found that, when a sulfur sensitization is carried out in presence of a nitrogen-containing heterocyclic compound capable of forming a complex with silver, a high sensitization can be achieved in particular with keeping down the fogs substantially. The findings mean that the method of sulfur sensitization carried out in presence of a nitrogen-containing heterocyclic compound capable of forming a complex with silver is remarkably effective to make a light-sensitive material highly sensitive without increasing fogs. However, it was also found that this remarkably effective sensitizing method still has a serious problem, that is, the gradations will greatly be varied according to the illuminance of an exposure light. It has so far been a well-known phenomenon that a sensitivity will be varied by changing a illuminance even if an exposure light quantity remains as it is the same. To this phenomenon, the countermeasures have been taken to change an exposure light quantity so as to correspond to a predicted sensitivity change or in like manner, therefore, the phenomenon does not affect so much in practical use.

Nevertheless, if a gradation change cause by an exposure light illuminance (hereinafter called a gradation dependence on illuminance) is great, the light-sensitive material will be vitally affected in quality. Light-sensitive materials are so designed in accordance with the purposes of their usage as to desirably differentiate the gradations each. When actually exposing such a light-sensitive material to light, the exposure illuminance thereto is naturally changed in accordance with the exposure conditions, for example, the brightness of a photographic object and the like in the case of a photographing light-sensitive material, and an image-density difference caused by the over- or under-exposure of an original photo-film in the case of a light-sensitive material for prints. In a light-sensitive material having a great gradation dependence on illuminance, the actual gradations thereof are shifted out of the permitted limit of the gradations of the target provided in the designing stage.

Therefore, the reproductions of images vary, according to the scenes photographed, sometimes to become so hard that the low- and high-density areas in particular can not be described, or sometimes to become so soft that the images will come out dull without any brilliance. In any case, the qualifications for the light-sensitive materials will be seriously damaged in quality.

In the light-sensitive materials for printing use, there are available a variety of print sizes which are popularly ranged from so-called E-size that is a small size up to the size of 18′×22′. Ordinarily, there are many cases where most of the users will try first to make a print in small size from the scenes photographed, and select therefrom some preferred scenes so as to make the enlargement into a larger size. In this instance, the original film is the same in either cases of printing one scene into a small size or a large size, and the intensity of a light source is also difficult to greatly increase. Therefore, when enlarging an image to a large-sized print, it cannot be avoided that an exposure illuminance to a light-sensitive material for printing use is lowered. As the result thereof, in the case that a gradation dependence on illuminance is great, an image-quality will be deteriorated in a large-sized print even if a desired image-quality may be obtained in a small-sized print, therefore, the users are unsatisfied.

The variations of a sensitivity caused by an exposure illuminance have not become a serious problem in practical use because an exposure means has been improved, however, the variations of gradation are very difficult to avoid by improving such an equipment as an exposure means or the like. It is, therefore, desired to improve a gradation dependency on illuminance, from the viewpoint of light-sensitive materials.

SUMMARY OF THE INVENTION

Objects of the Invention

It is an object of the invention to provide a light-sensitive material in which almost no fog is produced and the sensitivity is high and further the gradation does not depend or a very little depend upon an illuminance.

Constituents of the Invention

As the results of devoting the inventors themselves to their studies so as to achieve the above-mentioned object of the invention, they have found that the object of the invention can be achieved by a light-sensitive material containing a light-sensitive silver halide emulsion prepared in the manner that a silver halide emulsion containing an iridium compound is chemically sensitized by making use of an instable sulfur compound in presence of a nitrogen-containing heterocyclic compound capable of forming a complex with silver.

DETAILED DESCRIPTION OF THE INVENTION

The silver halide emulsions of the invention each containing the iridium compounds are those prepared by making at least one kind of the iridium compounds present when a silver halide is produced or physically ripened. It is preferred to contain the iridium compounds in the silver halide emulsions when the silver halide is produced. In this instance, the iridium compounds are allowed to add at any time, however, the addition of the iridium compounds is to be made at the time when the silver halide is produced of preferably from 5% to 95%, more preferably from 10 to 90% and most preferably from 20 to 80% of the total amount of a soluble silver which is to be used in producing the silver halide.

The iridium compounds which are to be used in the invention shall not specially be limited, however, those preferable from the industrial viewpoints of the stability, safety, economy and the like of the compounds include, for example, a halogenated iridium (III) compound, a halogenated iridium (IV) compound, a complex salt having a halogen, an amine, an oxalato or the like as a ligand, such as a hexammineiridium (III) or (IV) salt, a hexachloroiridium (III) or (IV) complex salt, a trioxalatoiridium (III) or (IV) salt and the like. These iridium compounds are to be used after they are dissolved in water or in a suitable solvent, and with the purpose of stabilizing the solutions of such iridium compounds, there are used a method of adding a halogenated hydrogen aqueous solution of, for example, hydrochloric acid, bromic acid, hydrofluoric acid, or a halogenated alkali such as potassium chloride, sodium chloride, potassium bromide, sodium bromide and the like, which is the popular method.

The amount of the iridium compounds to be added is from $10^{-8}$ to $10^{-=}$mole, and more preferably from $10^{-7}$ to $10^{-5}$ mole per mole of the silver halide to be used.

It has been well-known that the iridium compounds which are to be used in the embodiments of the invention are used by adding them in a silver halide photographic emulsion. British Patent No. 602,158 describes the stabilization of a silver halide emulsion made by the functions of a ruthenium salt, a paradium salt or an iridium salt; and U.S. Pat. No. 2,448,060 described a silver halide emulsion sensitized by adding at least one kind of a water-soluble ruthenium compound, a water-soluble rhodium compound, a water-soluble palladium compound, a water-soluble osmium compound, a water-soluble iridium compound and a water-soluble platinum compound, at the time of producing, dispersing it or, physically ripening or chemically ripening it or, at the time before coating it; Japanese Patent Examined Publication No. 4935/1973 described a light-sensitive material for flash-exposure use prepared by adding a water-soluble iridium compound at the time of precipitating or ripening a low sensitive and hardly toned silver halide emulsion; Japanese Patent Examined Publication No. 33781/1974 and Japanese Patent O.P.I. Publication No. 6725/1973 proposed respectively that the flash-exposure characteristics and the latent image stability of a light-sensitive material for flash-exposure use are improved by jointly adding a water-soluble iridium compound and a water-soluble rhodium compound at the time of emulsifying or physically ripening the silver halide emulsion used in the light-sensitive material.

Further, Japanese Patent O.P.I. Publication No. 88340/1977 describes that an iridium compound is added with the purpose of improving a temperature dependence at the time of light-exposure, and Japanese Patent O.P.I. Publication No. 51733/1981 describes that an iridium compound is added with the purpose of improving a fog and a desensitization caused by pressure.

However, there is no literature at all describing or suggesting any remarkable improvement on almost no fog occurrence, a high sensitivity and a gradation dependence upon illuminance, can be made on a silver halide emulsion prepared by sulfur sensitizing a silver halide emulsion containing an iridium compound, in the presence of a nitrogen-containing heterocyclic compound capable of forming a complex with silver; and such an improvement as described above has not been expectable.

As for silver halide emulsions of the invention, those prepared in any one of a neutralization method, an acidification method, or an ammonia method can be used, and inter alia the emulsions prepared in the acidification method are more preferred. They are better to prepare at a pH value of not higher than 5 and more preferably not higher than 4 in the course of producing silver halide particles.

A reaction of a soluble silver salt with a soluble halide may be made in anyone of a normal precipitation method, a reverse precipitation method, a double jet method or the combination thereof. Inter alia, the double jet method is preferred. In addition, a pAg-controlled double jet method, i.e., another type at the double jet methods, may also be used so as to improve monodispersibility, as described in Japanese Patent O.P.I. Publication No. 48521/1979 and the like.

If further required, a halogenated silver solvent of thioether or the like or a crystal habit modifier such as a mercapto group-containing compound or a sensitizing dye may also be used.

The particle size distribution of the silver halide particles used in the invention may be of a multidisperse type or of a monodisperse type either, however the latter type is more preferable. Herein, the monodisperse emulsion means that in the particle size distribution of the silver halide particles contained in an emulsion, of which the coefficient of variation is not more than 0.22 and more preferably not more than 0.15. Such coefficient of variation is a coefficient indicating the range of the particle size distribution and is defined by the following formulas;

$$\text{Coefficient of variation } (s/\gamma) = \frac{\text{Standard deviation of particle distribution}}{\text{Average particle size}}$$

-continued $$\text{Standard deviation } (s) = \sqrt{\frac{\Sigma\ (\gamma - ri)^2 ni}{\Sigma\ ni}}$$

$$\text{Average particle size } (\gamma) = \frac{\Sigma\ ni\ ri}{\Sigma\ ni}$$

wherein, ri represents the individual particle sizes of particles; and ni represents the number of the particles. There is no particular limitation to the silver halide composition of the silver halide particles being contained in the silver halide emulsion of the invention. It is, however, preferable that the silver halide emulsion of the invention is substantially a silver chlorobromide emulsion containing silver iodide in a small proportion. The substantial silver chlorobromide emulsions mentioned herein mean that the silver halide of the silver halide particles being contained in a silver halide emulsion comprises silver iodide in an amount of less than 1 mole % and the remaining matters comprising silver chloride and silver iodide. The silver chloride content of a silver halide particle is preferably not less than 5 mole %, and more preferably not less than 15 mole %.

In the silver halide particle being contained in the silver halide emulsions of the invention, any crystal habits thereof will do, however, the most preferable one is a tetrahedral particle so formed as to have both of a (100) face and a (111) face. The crystal faces of a silver halide particle is specified by the diffracted ray intensity ratio of a (200) face corresponding to a (100) face to a (222) face corresponding to a (111) face, namely $$K = \frac{\text{Diffracted ray intensity attributed to a (200) face}}{\text{Diffracted ray intensity attributed to a (222) face}}$$

the diffracted ray intensity ratio is obtained by such powder-method X-ray diffractometric analysis.

It is desired that the silver halide emulsions of the invention will contain silver halide particles within the range of $3 = K \leqq 500$ and preferably $10 \leqq K \leqq 400$.

The silver halide particles to be contained in the silver halide emulsions of the invention may be of the type that a latent image is formed mainly on the surfaces of the particles or of the type that the latent image is formed mainly inside the particles.

However, in order to satisfactorily display the effects of the invention, it is preferred that the silver halide particles of the type that a latent image is formed mainly inside the particles are to be avoided to use in such a state after the silver halide particles are formed and before they are chemically ripened, or such a state that the silver halide particles are ultimately formed in the case of chemically sensitizing the particles in the course of being formed. Typically speaking, the evaluation of the silver halide particles may be made in accordance with a method described in Japanese Patent Examined Publication No. 34213/1977. To be more concrete, in the case of testing a sample in accordance with an ordinary photographic testing technique in such a manner that the sample is prepared by coating on the polyethylene coated support thereof with a silver halide emulsion containing silver halide particles to be evaluated in a coating amount of silver of 40 mg per $dm^2$, and the sample resulted is exposed to a 500 W tungsten lamp for a certain period of time from $1 \times 10^{-2}$ to 1 sec. With a light-intensity scale, and is then developed in undermentioned developer Y, i.e., an internal development type developer, at the temperature of 18.3° C. for 5 minutes. When comparing the maximum density of the developed sample with that of a same-emulsion-coated sample which is exposed in the same manner as above but is developed in the undermentioned developer X, i.e., an external development type developer, at the temperature of 20° C. for 6 minutes, it is desired to use a silver halide emulsion containing silver halide particles having a maximum density of not more than ≡times and more preferably having only a maximum density of not more than 2 times.

| Developer X | |
|---|---|
| N—methyl-p-aminophenol sulfate | 2.5 g |
| ascorbic acid | 10.0 g |
| potassium metaborate | 35.0 g |
| potassium bromide | 1.0 g |
| add water to make | 1 l |
| | (pH = 9.6) |

| Developer Y | |
|---|---|
| N—methyl-p-aminophenol sulfate | 2.0 g |
| sodium sulfite, anhydrous | 90.0 g |
| hydroquinone | 8.0 g |
| sodium carbonate . $1H_2O$ | 52.5 g |
| potassium bromide | 5.0 g |
| potassium iodide | 0.5 g |
| add water to make | 1 l |
| | (pH = 10.6) |

In the nitrogen-containing heterocyclic compounds to be used in the invention, the heterocyclic rings include, for example, a pyrazole ring, a pyrimidine ring, a 1,2,4-triazole ring, a 1,2,3-triazole ring, a 1,3,4-triadiazole ring, a 1,2,3-thiadiazole ring, a 1,2,4-thiazole ring, a 1,2,5-thiadazole ring, a 1,2,3,4-tetrazole ring, a pyridazine ring, a 1,2,3-triazine ring, a 1,2,4-triazine ring, a 1,3,5-triazine ring, and such a ring having bound 2 or 3 of the above-mentioned rings as a triazolotriazole ring, a diazaindene ring, a triazaindene ring, a tetrazaindene ring, a pentazaindene ring, and the like. There may also be applied a heterocyclic ring in which a unit ring type heterocyclic ring is bound to an aromatic ring such as a phthalazine ring, a benzimidazole ring, an indazole ring, a benzothiazole ring and the like.

Among the above-mentioned rings, the preferable one is an azaindene ring, and the more preferable one is an azaindene compound having a hydroxy group which may serve as a substituent, including, for example, a hydroxytriazaindene compound, a hydroxytetrazaindene compound, a hydroxypentazaindene compound and the like.

Such heterocyclic rings may have the other substituents than the above-mentioned hydroxy group. The above-mentioned other substituents include, for example, an alkyl group, a substitute alkyl group, an alkylthio group, an amino group, a hydroxyamino group, an alkylamino group, a dialkylamino group, an arylamino group, a carboxy group, an alkoxycarbonyl group, a halogen atom, a cyano group and the like.

The typical examples thereof are listed below, and it is to be understood, however, that the invention shall not be limited thereto:

(N-1) 2,4-dihydroxy-6-methyl-1,3a,7-triazaindene,
(N-2) 2,5- dimethyl-7-hydroxy-1,4,7a-triazaindene,
(N-3) 5-amino-7-hydroxy2-methyl-1,4,7a-triazaindene, (N-4) 4-hydroxy-6-methyl-1,3a,7-tetrazaindene,
(N-5) 4-hydroxy-1,3,3a,7-tetrazaindene,
(N-6) 4-hydroxy-6-phenyl-1,3,3a,7-tetrazaindene,
(N-7) 4-methyl-6-hydroxy-1,3,3a,7-tetrazaindene,
(N-8) 2,6-dimethyl-4-hydroxy-1,3,3a,7-tetrazaindene,
(N-9) 4-hydroxy-5--ethyl-6-methyl-1,3,3a,7-tetrazaindene,
(N-10) 2,6-dimethyl-4-hydroxy-5-ethyl-1,3,3a,7-tetrazaindene,
(N-11) 4-hydroxy-5,6-dimethyl-1,3,3a,7-tetrazaindene,
(N-12) 2,5,6-trimethyl-4-hydroxy-1,3,3a,7-tetrazaindene,
(N-13) 2-methyl-4-hydroxy-6-phenyl-1,3,3a,7-tetrazaindene,
(N-14) 4-hydroxy-6-methyl-1,2,3a,7-tetrazaindene,
(N-15) 4-hydroxy-6-ethyl-1,2,3a,7-tetrazaindene,
(N-16) 4-hydroxy-6-phenyl-1,2,3a,7-tetrazaindene,
(N-17) 4-hydroxy-1,2,3a,7-tetrazaindene,
(N-18) 4-methyl-6-hydroxy-1,2,3a,7-tetrazaindene,
(N-19) 7-hydroxy-5-methyl-1,2,3,4,6-pentazaindene,
(N-20) 5-hydroxy-7-methyl-1,2,3,4,6-pentazaindene,
(N-21) 5,7-dihydroxy-1,2,3,4 6-pentazaindene,
(N-22) 7-hydroxy-5-methyl-2-phenyl-1,2,3,4,6-pentazaindene, and
(N-23) 5-dimethylamino-7-hydroxy-2-phenyl-1,2,3,4,6-pentazaindene, The amount of such nitrogen-containing heterocyclic compounds to be added will vary in a wide range in accordance with the sizes, composition, ripening conditions of emulsion particles and the like. It is, however, preferred that they may be added in an amount of from $2\times10^{-5}$ to 0.02 mole per mole of a silver halide used. How to add the above-mentioned compounds into an emulsion is that the compounds are dissolved in a suitable solvent such as water or an aqueous alkaline solution which is incapable of affecting a photographic emulsion with a harmful action, and is then added in the form of a solution. The point of time of adding the compounds is preferably before or at the same time as they are added with a sulfur sensitizer to be chemically ripened.

In the invention, the instable sulfur compounds are such a compound as a sulfur sensitizer so-called in the photographic field, which will produce silver sulfide when it is added into an aqueous solution of silver nitrate, as described in Japanese Patent Examined Publication No. 13489/1968.

In the invention, any well-known sulfur sensitizers may be used. For example, they include a thiosulfate, an allylthio carbamide, thiourea, allylisothio cyanate, cystine, a p-toluene thiosulfonate, rhodanine and the like. Besides the above, there may also be used such a sulfur sensitizer as described in U.S. Pat. Nos. 1,574,944, 2,410,689, 2,278,947, 2,728,668, 3,501,313, and 3,656,955; German Patent No. 1,422,869; Japanese Patent Examined Publication No. 24937/1981; and Japanese Patent O.P.I. Publication No. 45016/1980. An amount of the sulfur sensitizer added is to be as much as the sensitivity of an emulsion may effectively be increased. The amount thereof to be added will vary in considerable range according to the various conditions of an amount of hydroxyazaindene added, a pH value, a temperature, a size of a silver halide particles. A criterion thereof is preferably of the order of from about $10^{-7}$ to $10^{-1}$ mole per mole of silver halide used.

In addition, if required, one or more kinds of the other chemical sensitizers may be used in combination. The sensitizers capable of being used in combination include, for example, a selenium sensitizer; a reduction sensitizer such as a stannous salt, a polyamine and the like; a noble metal sensitizer such as a gold sensitizer and more concretely a sodium chloroaurate, potassium aurothiocyanate and the like.

The silver halide emulsions of the invention can be spectrally sensitized in a desired wavelength region by making use of a sensitizing dye. The sensitizing dyes capable of being used in the invention include, for example, those of cyanine type, merocyanine type, hemicyanine type, oxonol type, hemioxonol type and complex merocyanine type. They are described in, for example, F. M. Hamer, 'The Cyanine Dye and Related Compounds', and C. T. H. James, 'The Theory of the Photographic Process' 4th Edition, pp. 194~234, and the like. In particular, it is most preferred to use the sensitizing dyes represented by the following Formula [I]. Formula [I]

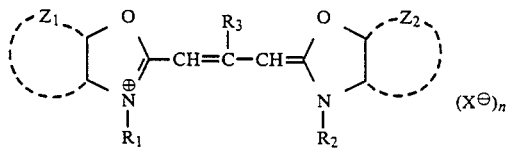

wherein $Z_1$ and $Z_2$ represent a group of atoms necessary for forming a benzene ring or a naphthalene ring condensed into an oxazole ring, respectively: $R_1$ and $R_2$ represent an alkyl group. an alkenyl group or aryl group, respectively; $R_3$ represents hydrogen or an alkyl group having one to 3 carbon atoms: $H^{\ominus}$represents an anion; and n is zero or one.

In Formula [I], a naphthalene ring or benzene ring formed by $Z_1$ and $Z_2$ is allowed to be substituted by a variety of substituents, and among them, the preferable substituents are a halogen, an aryl group, an alkyl group or an alkoxy group. A further preferable substituent is a halogen, a phenyl group, or methoxy group, and the most preferable substituent is a phenyl group.

According to a suitable embodiment of the invention, $Z_1$ and $Z_2$ each represent a benzene ring condensed into an oxazole ring, respectively, and at least one of the benzene rings is substituted by a phenyl group at the 5th position of the very benzene ring, or one of the benzene rings is substituted by a phenyl group at 5th position thereof and the other benzene rings are substituted by a halogen atom at the 5th position thereof, respectively.

$R_1$ and $R_2$ each represent an alkyl group, an alkenyl group or an aryl group, and preferably an alkyl group, and more preferably an alkyl group substituted by a carboxy group or a sulfo group, and still more preferably a sulfoalkyl group having one to 4 carbon atoms, and most preferably a sulfoethyl group. $R_3$ represents hydrogen or an alkyl group having one to $ carbon atoms, and preferably hydrogen, a methyl group or an ethyl group.

$X^{\ominus}$ represents an anion including, for example, those of Cl, Br, I,

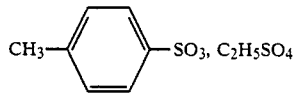

and the like. n is zero or one, and is zero provided that the compound forms an intermolecular salt.

Next, the typical examples of the sensitizing dyes represented by the Formula [I]will be given below:
[I-1]
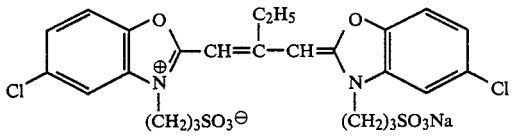
[I-2]
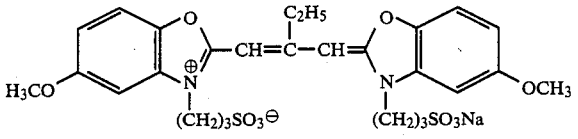
[I-3]
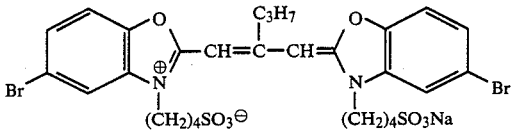
[I-4]
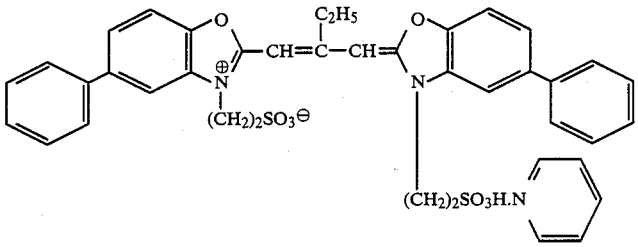
[I-5]
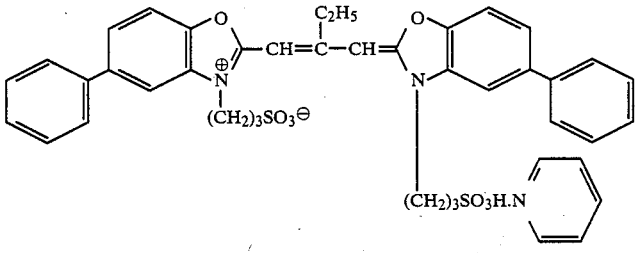
[I-6]
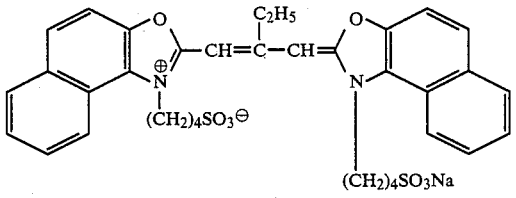
[I-7]
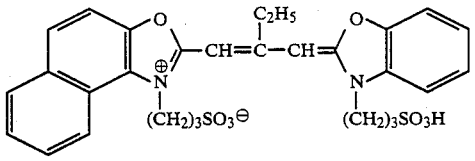
[I-8]
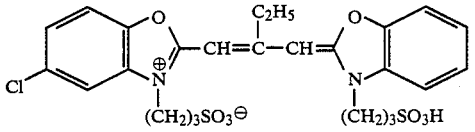

-continued

[I-9]

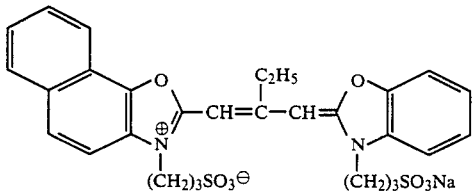

[I-10]

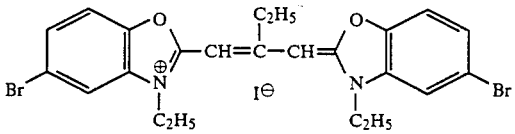

[I-11]

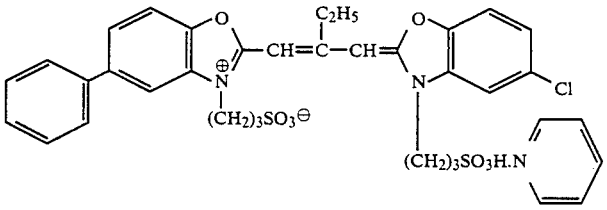

[I-12]

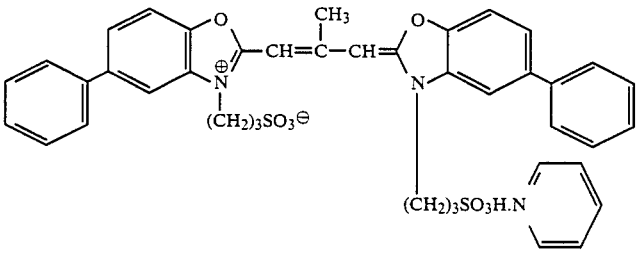

[I-13]

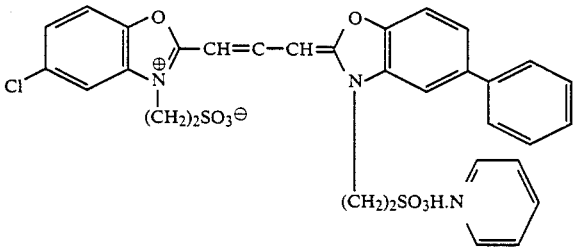

The abovegiven sensitizing dyes are well-known and can readily be synthesized in such a method as described in F. M. Harmer, 'the Chemistry of Heterocyclic Compounds' Vol. 18, and the aforedescribed 'The Cyanine Dyes and Related Compounds'.

The time of adding such sensitizing dyes may be any time in the course of emulsion preparing process, and preferably in the course of or after a chemical ripening process, and more preferably in the course of a chemical ripening process.

In the invention, a pAg value of an emulsion in the course of a chemical ripening process is preferably within a range of from 5.5 to 8.5, and more preferably within a range of from 6.0 to 7.5.

The silver halide emulsions of the invention are allowed to be added with a hydroxyazaindene compound at the time when a chemical ripening process is completed, with the purpose of preventing a light-sensitive material from occurring a fog in the course of the preparation processes, preservation or the developing process, or with the purpose of stabilizing the photographic characteristics of the light-sensitive material, and further, a variety of other compounds may also be added thereto.

There may be added with a variety of compounds having been well-known as an antifoggant or a stabilizer including, for example, an azole such as a benzothiazolium salt; a nitroindazole; a nitrobenzimidazole, a chlorobenzimidazole; a bromobenzimidazole; a mercaptothiazole; a mercaptobenzimidazole; an aminotriazole; a benzotriazole; a nitrobenzotriazole; a mercaptotetrazole and inter alia 1-phenyl-5-mercaptotetrazole; and the like; and besides, a mercaptopyrimidine; a mercaptotriazine such as a thioketo compound including oxazolinethion; and further, benzenethiosulfinic acid; benzenesulfinic acid, benzenesulfonic acid amide; a hydroquinone derivative; an aminophenol derivative; a gallic acid derivative; an ascorbic acid derivative; and the like.

As for the binders, it is justifiable to use a gelatin, a colloidal albumin, agar-agar, gum arabic, alginic acid or hydrolyzed cellulose acetate, acrylamide, imide polyamide. polyvinyl alcohol, hydrolyzed polyvinyl acetate, a water-soluble polymers such as described in, for example, British Patent No. 523,611, German Patent Nos. 2,255,711 and 2,046,682, U.S. Pat. No. 3,341,332, and the like. The gelatin derivatives include, for example, such a phenylcarbamyl gelatin as described in U.S. Pat. No. 2,614,928 and 2,525,753, an acylated gelatin, a phthalated gelatin, or a gelatin derivative in which gelatin is graft-polymerized to a polymerizable monomer having an ethylene group, such as acrylic acid, styrene, an acrylic acid ester, methacrylic acid. a methacrylic acid ester and the like; and these hydrophilic colloids are used in a layer containing a silver halide, or an auxiliary layer not containing a silver halide such as a filter-layer, protective layer, interlayer and the like.

As for the hardening agents, it is possible to use, independently or in combination, such an organic hardening agent as those of vinylsufonic type, acryloyl type, ethyleneimine type, cyanuric chloride type, carbodiimide type and the like; or an inorganic hardening agent such as chrome alum, potassium alum and the like.

The light-sensitive materials of the invention, a surface active agent may be added, with the purposes of assisting a coating process, preventing an electrostatic, improving slip property and an emulsification-dispersion, preventing an adhesion, and the like.

The examples of such surface active agents to be used include not only saponin, sodium dodecylbenzene sulfonate, and sodium sulfosuccinate, but also those given in Japanese Patent O.P.I. Publication Nos. 46733/1974, 10722/1974 and 16525/1975.

In the case of applying the light-sensitive materials of the invention to a color light-sensitive material, a variety of couplers may be used. As for the yellow-couplers, an open-chained ketomethylene type coupler may be used, and in particular a pivaloyl acetanilide type compound is useful; as for the magenta-couplers, the compounds of a pyrazolone type, pyrazolotriazole type, pyrazolinobenzimidazole type, indazolone type and the like may be used; and as for the cyan couplers, the compounds of phenol type, naphthol type and the like may be used. These couplers may be of either a two-equivalent type or a four-equivalent type. In addition, in a photographic emulsion used in this case, there may be used a colored magenta coupler, a colored cyan coupler, or a DIR coupler, a Weiss coupler, a competing coupler and the like. Further, as for the ultra-violet ray absorbing agents, there may be used, for example, a benzotriazole compound, a thiazolidone compound, an acylonitrile compound, a benzophenone compound and the like. Besides the above, there may also be used an antistatic agent, an optical brightening agent, an antioxidant, an antistaining agent and the like, if required.

In the case that a silver halide emulsion of the invention is contained with a photographic additive and is then formed into a silver halide emulsion layer on the support of a light-sensitive material, it is coated on the support with the interposition of a subbing layer, interlayer and the like, if required.

The supports to be used in the case includes, for example, those made of paper, glass-plate, cellulose acetate, cellulose nitrate, a polyester, a polyamide, a polystyrene or the like; or a material made by pasting two or more kinds of sub-base materials together such as a paper-polyolefin (e.g., a polyethylene, a polypropylene or the like) laminated material. These supports are generally applied with a variety of surface improving treatments for improving the adhesion thereof to a silver halide emulsion used. For example, they are used after being applied with such a surface treatment as an electric-impact treatment or the like, and with a subbing treatment for providing a subbing layer thereonto.

How to coat a silver halide emulsion onto the above-mentioned support and to dry up is to ordinarily be made in a well-known coating processes including, for example, a dip-coating, a roller-coating, a bead-coating, a curtain-flow coating or the like, and dried up.

A light-sensitive material is processes in an ordinary black-and-white development or a color-development.

The color developing agents useful for color developments include, for example, an aromatic primary amine compound such as N,N-diethyl-p-phenylenediamine, N-ethyl-N-hydroxyethyl-p-phenylenediamine, 4-(N-ethyl-N-hydroxyethyl)amino-2-methylaniline, 4-N-ethyle-N-β-methanesulfonamidoethyle)amino-2-methylaniline, 4-(N,N-diethyl)amino-2-methylaniline, 4-(N-ethyl-N-methoxyethyl)amino-2-methylaniline, and the sulfate, hydrochloride sulfite, p-toluenesulfonate thereof and the like, respectively.

After a color development is completed. a bleaching-fixing process is then carried out. A preferable bleaching agent for bleaching a developed silver is an organic acid polyvalent metal salt including, for example, an organic acid ferric salt The typical examples thereof are the ferric salts of nitrilotriacetic acid, diethylenetriaminepentaacetic acid, ethyleneglycol bis(aminoethylether)tetraacetic acid, diaminopropanoltetraacetic acid, N-(2-hydroxyethyl)ethylenediaminetriacetic acid, ethyliminodipropionic acid, cyclohexanediaminetetraacetic acid, ethylenediaminetetraacetic acid, or the like. It is also allowed to use a polycarboxylic acid iron salt such as the iron salts of oxalic acid, malonic acid, succinic acid, tartaric acid, malic acid, citric acid, salicylcic acid, and the like, described in Japanese Patent O.P.I. Publication NO. 107737/1974. As for the polyvalent metals, a cupric salt and a cobalt (II) salt, besides the above-mentioned ferric salts, may also be used. Further, according to the purposes, a polyvalent metal salt such as ferric chloride ferric sulfate and the like may be used. The fixers capable, of being contained include, for example, a thiosulfate, a thiocyanate and the like which have so far been well-known; such a water-soluble alkali metal salt as potassium bromide, ammonium bromide, sodium iodide and the like such as described in Japanese Patent O.P.I. Publication No. 01934/1973; and a bromide or iodide of ammonium.

It is also possible to apply each of the processes such as a prehardening, neutralizing, washing, stabilizing processes and the like, in combination with a color developing process and a bleaching-fixing process.

EXAMPLE

The invention will now be detailedly described below with reference to the examples. It is, however, to be understood that the invention shall not be limited thereto.

Example 1

The starting silver chlorobromide emulsions called Em-1 to Em-7 were prepared in a double-jet precipitation method under the following conditions:

Em-1: A silver salt solution and a halide solution were added together by controlling the amounts added thereof with constantly maintaining the temperature at 55° C., the pAg to 7.5 and the pH value to 6.0, and the particles thereof were grown. After they were grown up, a desalting step and a washing step were carried out in a usual method.

Em-2: This emulsion was prepared under the same conditions as those of Em-1, except that $K_2IrCl_6$ was added therein in an amount of $1\times10^{-6}$ mole per mole of a silver halide used, when 97% of the total amount of the silver salt solution were added in the course of growing the particles thereof. After the growth was completed, a desalting step and a washing step were carried out in a usual method.

Em-3: This emulsion was prepared in the same conditions as those of Em-1, except that $K_2IrCl_6$ was added therein in an amount of $1\times10^{-6}$ mole when 60% of the total amount of a silver salt solution were added in the course of growing the particles thereof. After the growth thereof was completed, a desalting step and a washing step were carried out in a usual method. In the three kinds of the emulsions thus prepared, the silver halide particles thereof comprised silver chloride of 20 mole % and silver bromide of 80 mole %.

The three kinds of the emulsions comprised monodisperse tetradeca hedral particles of K =75 having a coefficient of variation of 0.11.

Em-4: A silver salt solution and a halide solution were added together by controlling the amounts added thereof with constantly maintaining the temperature at 55° C., the pAg to 7.5 and the pH value to 3.0, and the particles thereof were grown. Then. $K_2IrCl_6$ was added therein in an amount of $1\times10^{-6}$ mole per mole of a silver halide used when 60% of the total amount of the silver halide solution were added. After the particle growth was completed, the pH value thereof was adjusted to 6.0 and a desalting step and a washing step were carried out in a usual method.

Em-5: This emulsion was prepared on the same conditions as those of Em-4, except that $K_2IrCl_6$ was added in an amount of $5\times10^{-6}$ mole per mole of a silver halide used.

In Em. 4 and Em. 5, the silver halide particles thereof comprised silver chloride of 20 mole % and silver bromide of 80 mole %, respectively. These emulsions comprised monodisperse tetradeca hedral particles of K=72 having a coefficient of variation of 0.12, respectively.

Em-6: This emulsion was prepared on the same conditions as those of Em-4, except that the pAg was adjusted to 8.2.

Em-7: This was prepared on the same conditions as those of Em-4, except that the pAg was adjusted to 6.0.

In the two kinds of the silver halide emulsions, Em-6 and Em-7, thus prepared, the silver halide particles thereof comprised silver chloride of 20 mole % and silver bromide of each. However, Em-6 comprised monodisperse octahedral particles of K=0.8 having a coefficient of variation of 0.12, and Em-7 comprised cubic particles of K=1600 having a coefficient of variation of 0.10.

Em-8: In a modified process of the process described in Japanese Patent O.P.I. Publication No. 140444/1984, there was prepared a tetradeca hedral monodisperse emulsion of K=83 having a coefficient of variation of 0.13, comprising silver bromide and silver chloride provided in order from the inside of the silver halide particles and silver bromide on the uppermost surface of the particles, and of which the silver halide particles comprised silver chloride of 20 mole % and silver bromide of 80 mole %. And, $K_2IrCl_6$ was added therein in an amount of $1\times10^{-6}$ mole per mole of the silver halide used.

When Em-1 through Em-8 were tried to make surface-developments and internal-developments in accordance with the above-mentioned process, it was found that the ratio of each maximum density obtained after the internal developments to that obtained after the surface developments was not more than 2 in the cases of Em-1 through Em-7, and was 18 in the case of Em-8.

Next, the test emulsions em-a through em-k were prepared by chemically ripening the starting emulsions Em-1 through Em-7 under the following conditions.

In the preparations of the test emulsions, the amounts of the additives each added will hereinafter be expressed by an amount added per mole of the silver halide used in the emulsions.

The em-a was prepared in such a manner that 300mg of the afore-mentioned compound N-4 were added in Em-1 with keeping the temperature at 55° C. and 8mg of sodium thiosulfate pentahydrate were added therein, and a chemical ripening process was applied thereto in a usual method. After completed the ripening, 1 g of the aforementioned hydroxytetrazaindene was added.

In the same manner, em-b, c, d, e, f, g and h were prepared by making use of Em-2, 3, 4, 5, 6, 7 and 8 in place of Em-1, respectively.

The em-i and j were prepared in such a manner that the aforementioned compound N-6 or N-11 was added in place of N-4 and was then chemically ripened under the same conditions as those of the preparation of em-d.

The em-k was prepared in such a manner that a silver nitrate solution was added before adding N-4 into Em-4 and the pAg was adjusted to 6 3, and then a chemical ripening process was applied under the same conditions as those of preparation of em-d.

The em-l was prepared in such a manner that 6 mg of sodium thiosulfate pentahydrate were added in Em-1 by keeping a temperature at 55° C. and was chemically ripened, and then 1 g of N-4 was added.

To the em-a through em- prepared as described above, the following magenta coupler dissolved in dibutylphthalate was added in an amount of 0.2 mole per mole of silver halide used, and the resulted emulsions were coated over to polyethylene-coated paper sheets respectively so that the amount of silver coated can be 3.5 mg/dm$^2$ and the amount of gelatin can be 10 mg/dm$^2$, and were then dried up to prepare the coated samples No. 1 through No. 12, respectively.

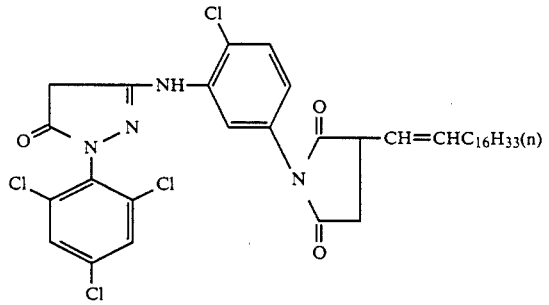

These samples were exposed to light through a wedge and processed in the following steps. After then, each of the sensitivities and fogs thereof were measured.

| <Processing Steps> | | |
|---|---|---|
| Color development | 33° C. | 3 min. 30 sec. |
| Bleach-fix | 33° C. | 1 min. 30 sec. |
| Wash | 33° C. | 3 min. |
| Dry | 80° C. | — |

| <Composition of Color Developer> | |
|---|---|
| N—ethyl-N—β-methanesulfonamidoethyl-3-methyl-4-aminoamiline sulfate | 4.0 g |
| hydroxylamino.sulfate | 2.0 g |
| potassium carbonate | 25.0 g |
| sodium chloride | 0.1 g |
| sodium bromide | 0.2 g |
| sodium sulfite, anhydrous | 2.0 g |
| benzyl alcohol | 10.0 ml |
| polyethylene glycol (mean degree of polymerization: 400) | 3.0 ml |
| Add water to make 1 l, and adjust the pH value to 10.0 by making use of sodium hydroxide. | |

| <Composition of Bleaching-Fixing Solution> | |
|---|---|
| iron sodium ethylenediaminetetraacetate | 60.0 g |
| ammonium thiosulfate | 100.0 g |
| sodium bisulfite | 20.0 g |
| sodium methabisulfite | 5.0 g |
| Add water to make 1 l, and adjust the pH value to 7.0 by making use of sulfuric acid. oxidation-reduction potential is to be −70 mV. | |

Next, the respective tests for each gradation dependency upon illuminance were tried by making use of the above-mentioned samples in the following manner.

Each of the samples was exposed to light through a wedge in the same light quantity for 0.05 sec. (i.e., under a high illuminance condition) and for 10 sec. (i.e., under a low illuminance condition), respectively. Then, they were applied to the same color development process as that used for the sensitivity measurements. The resulted samples were measured for sensitometry so as to inspect the variations of gradation ($\Delta\bar{\gamma}$). The results thereof are shown in Table 1.

Herein, Δ represents a value expressing a gradation, and $\bar{\gamma}\Delta$represents a difference between Δ obtained when making an exposure under a high illuminance condition and Δ obtained when making an exposure under a low illuminance condition. The less this value is, the less a gradation dependency upon illuminance is, and such a light-sensitive material is an excellent one.

TABLE 1

| Sample No. | Test Emulsion | Starting Emulsion | Particle formation pH | Particle formation $K_2IrCl_6$ mole/AgX in mole | Crystal habit | Nitrogen-containing heterocyclic compound (Amount added, mg/mole AgX) | Sensitometry Relative sensitivity | Sensitometry Dmin | Variation of gradation $\Delta\bar{\gamma}$ |
|---|---|---|---|---|---|---|---|---|---|
| 1 (Comparative) | a | Em-1 | 6.0 | — | Tetradeca hedron | N-4 (300) | 253 | 0.05 | 0.98 |
| 2 (Invention) | b | Em-2 | 6.0 | $1 \times 10^{-6}$ (97%)* | " | " | 257 | 0.05 | 0.39 |
| 3 (Invention) | c | Em-3 | 6.0 | $1 \times 10^{-6}$ (60%) | " | " | 263 | 0.05 | 0.28 |
| 4 (Invention) | d | Em-4 | 3.0 | $1 \times 10^{-6}$ (60%) | " | " | 267 | 0.04 | 0.20 |
| 5 (Invention) | e | Em-5 | 3.0 | $5 \times 10^{-6}$ (60%) | " | " | 253 | 0.04 | 0.22 |
| 6 (Invention) | f | Em-6 | 3.0 | $1 \times 10^{-6}$ (60%) | Octa hedron | " | 188 | 0.05 | 0.29 |
| 7 (Invention) | g | Em-7 | 3.0 | $1 \times 10^{-6}$ (60%) | Cube | " | 254 | 0.04 | 0.36 |
| 8 (Invention) | h | Em-8 | — | $1 \times 10^{-6}$ (60%) | Tetradeca hedron (laminated type) | " | 210 | 0.05 | 0.41 |
| 9 (Invention) | i | Em-4 | 3.0 | $1 \times 10^{-6}$ (60%) | Tetradeca hedron | N-6 (300) | 275 | 0.04 | 0.24 |
| 10 (Invention) | j | Em-4 | 3.0 | $1 \times 10^{-6}$ (60%) | " | N-11 (300) | 246 | 0.04 | 0.24 |
| 11 (Invention) | k | Em-4 | 3.0 | $1 \times 10^{-6}$ (60%) | " | N-4 (300) pAg-adjusted | 302 | 0.04 | 0.19 |
| 12 (Comparative) | 1 | Em-1 | 6.0 | — | " | — | 100 | 0.08 | 0.28 |

*Percentage of a silver salt solution amount already injected against the total amount of the silver salt solution added, at the time of adding $K_2IrCl_6$ (time of adding $K_2IrCl_6$)

It is obvious from the table that a high sensitization can be achieved with inhibiting a fog occurrence by a sulfur sensitization in presence of a nitrogen-containing heterocyclic compound capable of forming a complex with silver. (Compare Sample No. 1 with No. 12) However, a gradation dependency upon illuminance is seriously deteriorated. In contrast with the above, the emulsions of the invention prepared by sulfur sensitizing an emulsion containing an iridium compound in presence of a nitrogen-containing heterocyclic compound capable of forming a complex with silver are less in fog occurrence, high in sensitivity and less in gradation dependency upon illuminance.

Example 2

Into Em-4, 350 mg of N-4 were added while keeping a temperature at 55° C., and 8 mg of sodium thiosulfate pentahydrate were added, and then a chemical ripening process was applied. Further, before the chemical ripening process is completed. sensitizing dye [I-5], [I-12 ] or [A] was added and after the ripening process is completed, 1 g of N-4 was added. Thus, the spectrally sensitized test emulsions em-m, n, and o were prepared, respectively. The pAg in the course of the chemical ripening process was so adjusted as to be 6.5. By making use of these emulsions, the coated Samples No. 13 through 15 were prepared in the processes described in Example 1, and then the tests for the gradation dependency upon illuminance thereof were tried, similar to Example 1. The results thereof are shown in Table 2, below.

TABLE 2

| Sample No. | Emulsion | Sensitizing Dye | $\Delta\overline{\gamma}$ |
|---|---|---|---|
| 13 | em-m | I-5 | 0.08 |
| 14 | em-n | I-12 | 0.11 |
| 15 | em-o | A* | 0.22 |

*Sensitizing dye A

Sensitizing Dye A

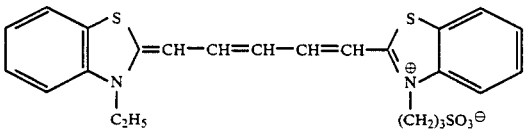

It is obvious from the table that the silver halide emulsions relating to the invention can display satisfactory effects even when they are spectrally sensitized with a sensitizing dye. In particle, the effects are remarkable when they are spectrally sensitized with the sensitizing dyes represented by Formula [I].

Example 3

In the method described in Example 2, an em-p was prepared by making use of sensitizing dye [B] to serve as a sensitizing dye.

And, em-q, r and s were prepared in such a manner that 6 mg of sodium thiosulfate pentahydrate were added into Em-1 while keeping a temperature at 55° C., and before completing a chemical ripening process sensitizing dye [B], [I-8] or [A] was added, and after the chemical ripening process was completed 1 g of N-4 was added.

Further, a multicoated sample No. 16 was prepared by coating the following layers in order onto a polyethylene-coated paper.

Herein, an amount of each compound added will be expressed by an amount added per 100cm2 of a color light-sensitive material.

Layer 1: A blue-sensitive emulsion layer comprising 7.8 mg of the following yellow coupler, em-p of 3.5 mg in terms of silver, and 20 mg of gelatin.

Layer 2: An interlayer comprising 0.2 mg of dioctyl hydroquinone, and 10 mg of gelatin.

Layer 3: A green-sensitive emulsion layer comprising 4.2 mg of the magenta coupler used in Example 1, em-m f 3.5 mg in terms of silver, and 20 mg of gelatin.

Layer 4: An interlayer comprising 0.3 mg of dioctyl hydroquinone, 8 mg of the following ultraviolet-ray absorbing agent, and 15 mg of gelatin.

Layer 5: A red-sensitive emulsion layer comprising 3.0 mg of the following cyan coupler, em-o of 2.5 mg in terms of silver, and 15 mg of gelatin.

Layer 6: An interlayer comprising 4.0 mg of an ultraviolet-ray absorbing agent and 10 mg of gelatin.

Layer 7: A protective layer containing 10 mg of gelatin.

Sensitizing Dye B

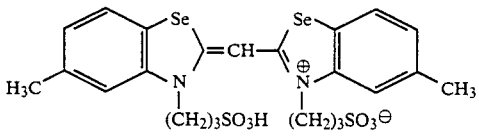

Yellow Coupler

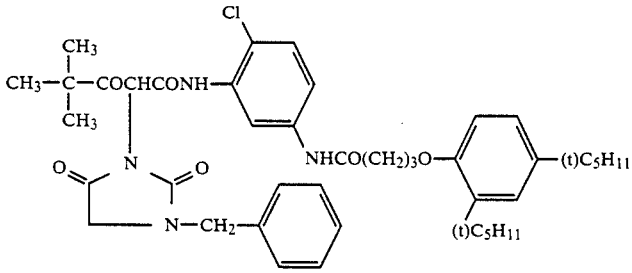

Ultraviolet-ray Absorbing Agent

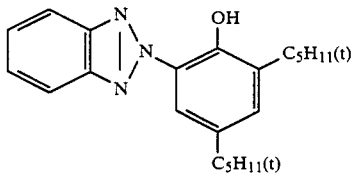

-continued

Cyan Coupler

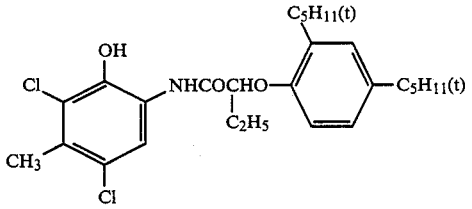

Next, multilayered sample No. 17 was prepared in such a manner that the em-p of Layer 1 of Sample No. 16 was replaced by em-q, the em-m of Layer 3 thereof was replaced by em-r and the em-o of Layer 5 thereof was replaced by em-s.

By making use of the Sample Nos. 16 and 17, the sensitometry and the gradation dependency upon illuminance thereof were evaluated in accordance with the methods described in Example 1. The results thereof are shown in Table 3.

TABLE 3

| | Relative Sensitivity (Dmin) | | | $\Delta\bar{\gamma}$ | | |
|---|---|---|---|---|---|---|
| Sample No. | B | G | R | B | G | R |
| 16 (Invention) | 242 (0.05) | 315 (0.04) | 275 (0.04) | 0.18 | 0.08 | 0.22 |
| 17 (Comparative) | 100 (0.09) | 100 (0.08) | 100 (0.06) | 0.23 | 0.30 | 0.47 |

The light-sensitive material of the invention are less in fog occurrence, hi9h in sensitivity and extremely less in gradation dependency upon illuminance.

What is claimed is:

1. A method of preparing a light-sensitive silver halide photographic emulsion comprising forming a silver halide emulsion containing photosensitive silver halide particles by mixing a solution containing a silver salt and a solution containing halide in the presence of an iridium compound, and chemically ripening said emulsion by the use of an instable sulfur compound as a sensitizer in the presence of a nitrogen-containing heterocyclic compound capable of forming a complex with silver.

2. The method of claim 1 wherein said iridium compound is selected from an iridium (III) compound or an iridium (IV) compound.

3. The method of claim 2 wherein said iridium compound is selected from an iridium (III) complex compound or an iridium (IV) complex compound.

4. The method of claim 1 wherein said iridium compound is present in an amount from $10^{-8}$ to $10^{-5}$ mole per mole of silver halide.

5. The method of claim 4 wherein said iridium compound is present in an amount from $10^{-7}$ to $10^{-5}$ mole per mole of silver halide.

6. The method of claim 1 wherein said iridium compound is added to the mixture when 5 to 95% of the total amount of said silver salt for forming said silver halide is present.

7. The method of claim 6 wherein said iridium compound is added to the mixture when 10 to 90% of the total amount of said silver salt for forming said silver halide is present.

8. The method of claim 6 wherein said iridium compound is added to the mixture when 20 to 80% of the total amount of said silver salt for forming said silver halide is present.

9. The method of claim 1 wherein said nitrogen-containing heterocyclic compound comprises a heterocyclic ring selected from the group consisting of a pyrazole ring, a pyrimidine ring, a 1,2,4-triazole ring, a 1,2,3-triazole ring, a 1,3,4-triadiazole ring, a 1,2,3-thiadiazole ring, a 1,2,4-thiazole ring, a 1,2,5-thiadiazole ring, a 1,2,3,4-tetrazole ring, a pyridazine ring, a 1,2,3-triazine ring, a triazolotriazole ring, a diazaindene ring, a triazaindene ring, a tetrazaindene ring, a pentazaindene ring, a phthalazine ring, a benzimidazole ring, an indazole ring and a benzothiazole ring.

10. The method of claim 9 wherein said nitrogen-containing heterocyclic compound is an azaindene compound having a hydroxy group.

11. The method of claim 1 wherein said nitrogen-containing heterocyclic compound is present in the emulsion in an amount from $2\times10^{-5}$ to 0.02 mole per mole of silver halide.

* * * * *